US007983609B2

(12) United States Patent
Yokota

(10) Patent No.: US 7,983,609 B2
(45) Date of Patent: Jul. 19, 2011

(54) IMAGE FORMING APPARATUS HAVING COLLECTION BOX

(75) Inventor: Eiji Yokota, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 371 days.

(21) Appl. No.: 12/245,313

(22) Filed: Oct. 3, 2008

(65) Prior Publication Data

US 2009/0092429 A1 Apr. 9, 2009

(30) Foreign Application Priority Data

Oct. 5, 2007 (JP) ..... 2007-262370

(51) Int. Cl.
*G03G 21/12* (2006.01)
*G03G 21/00* (2006.01)
*G03G 15/20* (2006.01)

(52) U.S. Cl. ..... 399/360; 399/123; 399/343; 399/357; 399/358

(58) Field of Classification Search ..... 399/360
See application file for complete search history.

(56) References Cited

U.S. PATENT DOCUMENTS

| | | | | |
|---|---|---|---|---|
| 5,933,690 | A * | 8/1999 | Sugimoto et al. | 399/257 |
| 2006/0110195 | A1 | 5/2006 | Fuji et al. | |
| 2006/0222401 | A1 | 10/2006 | Kamimura | |
| 2007/0147903 | A1 * | 6/2007 | Mori | 399/264 |
| 2007/0209539 | A1 | 9/2007 | Mori | |

FOREIGN PATENT DOCUMENTS

| | | |
|---|---|---|
| JP | 5-59478 | 8/1993 |
| JP | 8-87217 | 4/1996 |
| JP | 9-156794 | 6/1997 |
| JP | 2001-296779 | 10/2001 |
| JP | 2001-324905 | 11/2001 |
| JP | 2002-23448 | 1/2002 |
| JP | 2004-279919 | 10/2004 |
| JP | 2006-145819 | 6/2006 |
| JP | 2006-184453 | 7/2006 |
| JP | 2006-276447 | 10/2006 |
| JP | 2007-199675 | 8/2007 |
| JP | 2007-233072 | 9/2007 |

OTHER PUBLICATIONS

Japanese Official Action dated Feb. 16, 2010 together with English language translation.

* cited by examiner

*Primary Examiner* — David M Gray
*Assistant Examiner* — David Bolduc
(74) *Attorney, Agent, or Firm* — Scully, Scott, Murphy & Presser, PC

(57) ABSTRACT

An image forming apparatus is provided with a cassette configured to accommodate printing sheets, a casing of the image forming apparatus, a belt member which circularly moves inside the casing, a cleaning device configured to remove particles adhering on the belt member, and a collection box in which the particles removed by the cleaning unit is collected. The casing has a cassette accommodating section for accommodating the cassette, a box accommodating section defined inside the casing and communicating with the cassette accommodating section and an opening formed on the casing and communicating with the cassette accommodating section. The cassette is removably installable into the cassette accommodating section through the opening, and the collection box is detached from or inserted in the box accommodating section through the opening.

5 Claims, 8 Drawing Sheets

IMAGE FORMING APPARATUS HAVING COLLECTION BOX

CROSS-REFERENCE TO RELATED APPLICATION

This application claims priority under 35 U.S.C. §119 from Japanese Patent Application No. 2007-262370 filed on Oct. 5, 2007. The entire subject matter of the application is incorporated herein by reference.

BACKGROUND

1. Technical Field

The present invention relates to an image forming apparatus.

2. Prior Art

Conventionally, an image forming apparatus (e.g., a laser beam printer) employing an endless belt for feeding printing sheets and/or intermediate transfer of a toner image has been known. In such an image forming apparatus, there is known an apparatus employing a belt cleaning unit for scraping dust/particles (e.g., toner, particles of recording sheet, etc.) attached onto a surface of the belt by urging a blade, a roller or a brush to the surface of the belt, and collects the thus scraped dust/particles in a collection box. Examples of such a cleaning unit are disclosed in Japanese Patent Provisional Publications No. 2004-279919, No. 2001-296779 and No. 2001-324905.

SUMMARY OF THE INVENTION

In order to dispose the thus collected dust/particles, the collection box is generally detachable from the image forming apparatus. In the conventional apparatuses, however, the collection box should be removed from the image forming apparatus through a very narrow section surrounded by various components. That is, in the conventional art, in order to remove the collection box, a cover of the image forming apparatus is opened, and then the collection box is pulled out through a small section surrounded by imaging process unit, belts and the like.

In consideration of the above problem, the present invention is advantageous in that an improved image forming apparatus is provided, which is configured such that the collection box can be detached/attached relatively easily in comparison with the conventional art.

According to aspects of the invention, there is provided an image forming apparatus which is provided with a cassette configured to accommodate printing sheets, a casing of the image forming apparatus, a belt member which circularly moves inside the casing, a cleaning device configured to remove particles adhering on the belt member, and a collection box in which the particles removed by the cleaning unit is collected. The casing has a cassette accommodating section for accommodating the cassette, a box accommodating section defined inside the casing and communicating with the cassette accommodating section and an opening formed on the casing and communicating with the cassette accommodating section. The cassette is removably installable into the cassette accommodating section through the opening, and the collection box is detached from or inserted in the box accommodating section through the opening.

With the above configuration, the collection box can be detached/attached relatively easily in comparison with the conventional art.

BRIEF DESCRIPTION OF THE ACCOMPANYING DRAWINGS

Figure 6:
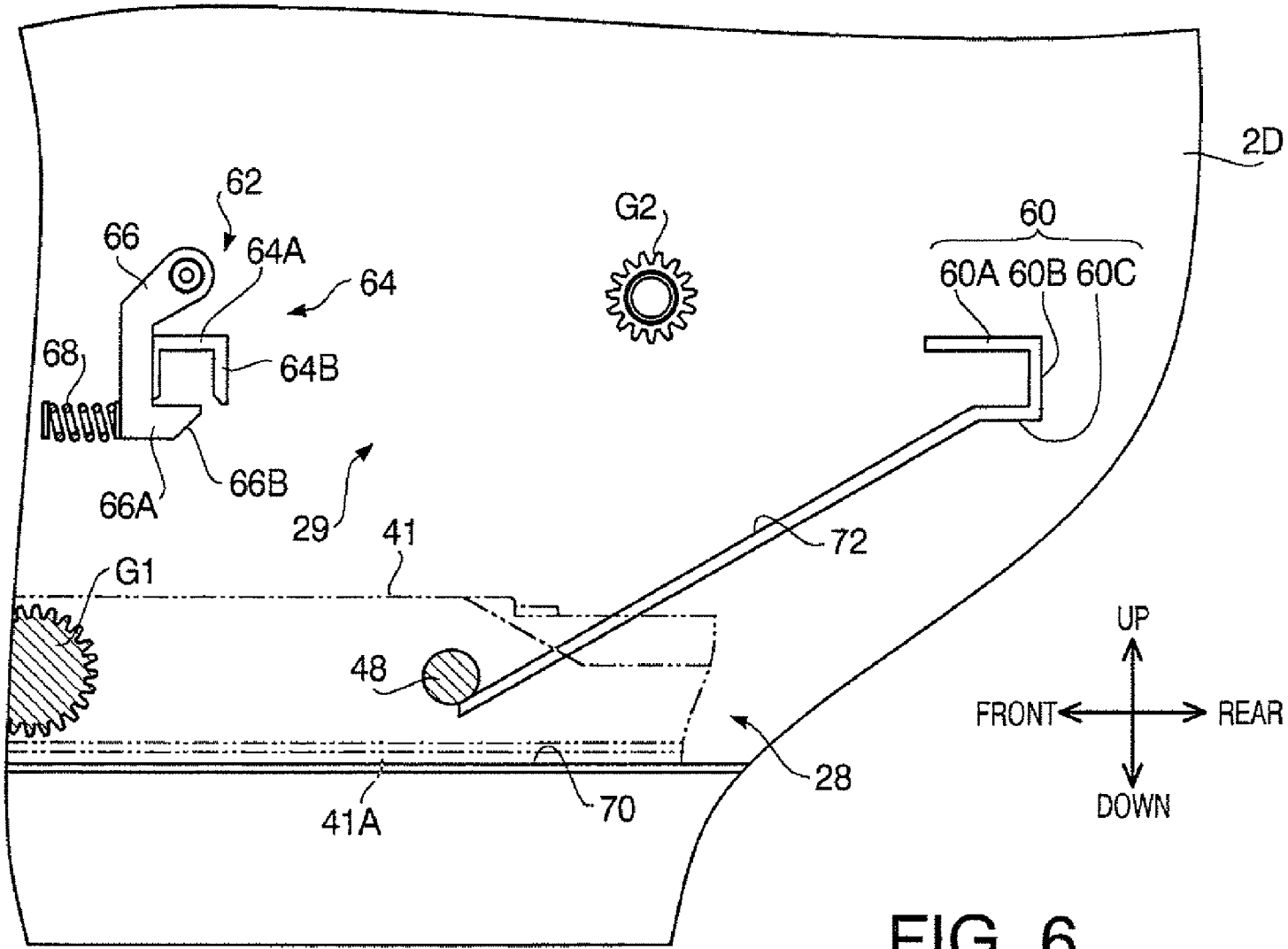
Figure 7:
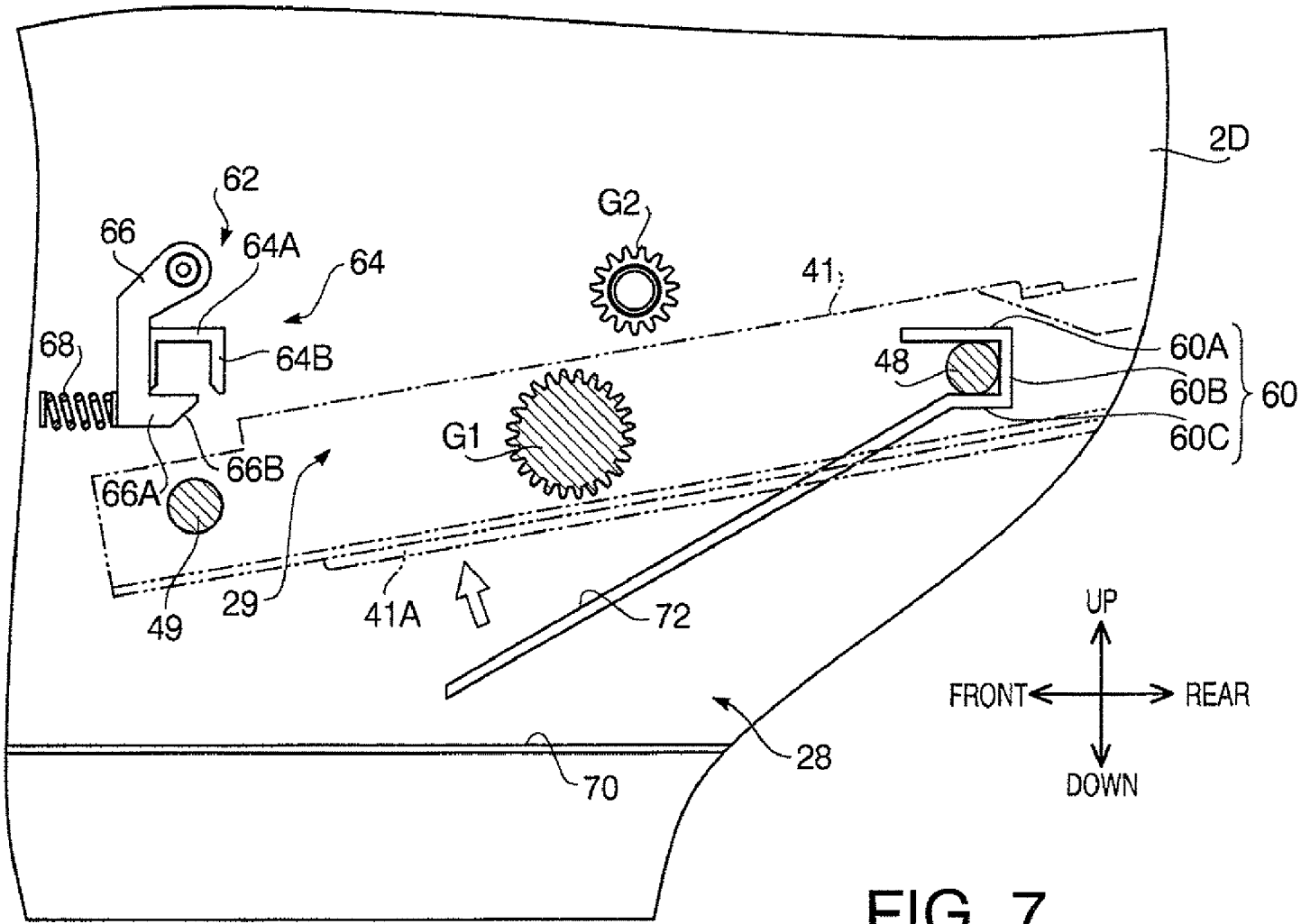
Figure 8:
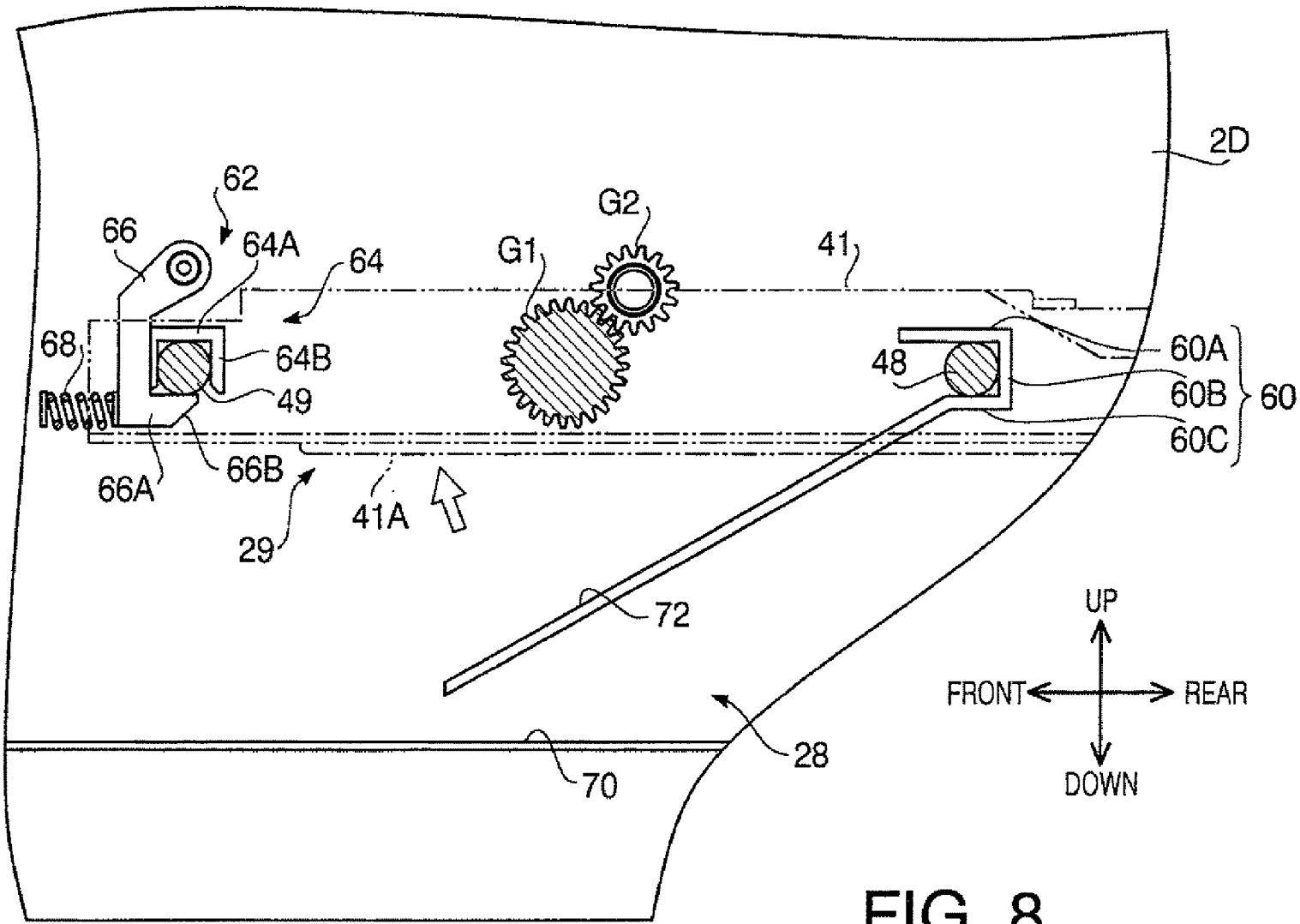

FIGS. 6-8 schematically show cross-sectional side views illustrating a process of attaching the belt cleaning unit to a unit accommodation section of the printer according to the embodiment of the invention.

DETAILED DESCRIPTION OF THE EMBODIMENT

Hereinafter, referring to the accompanying drawings, a printer 1 according to an embodiment of the invention will be described.

Figure 1:
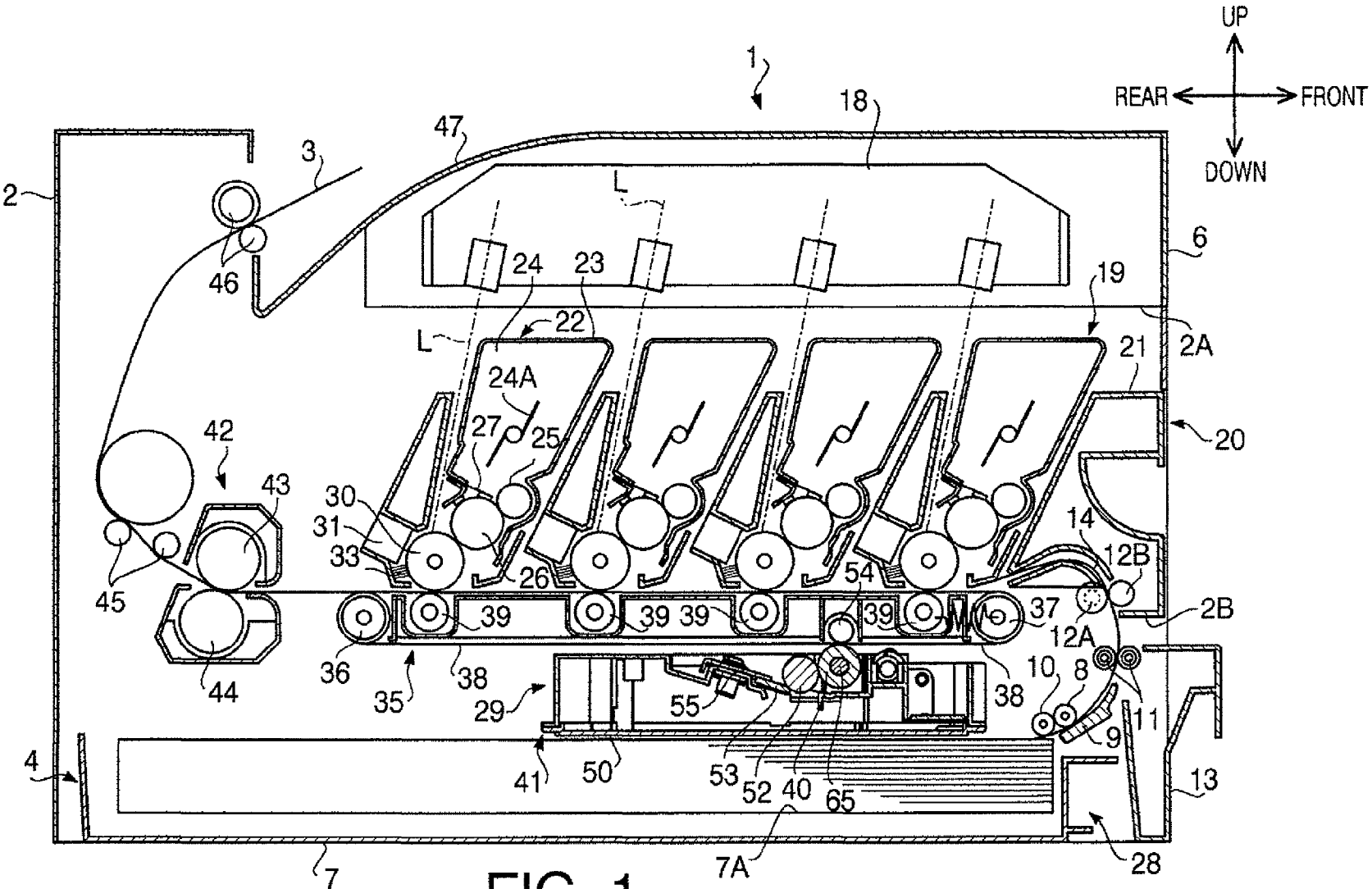
FIG. 1 is a cross-sectional side view of a printer according to an embodiment of the invention.
Figure 2:
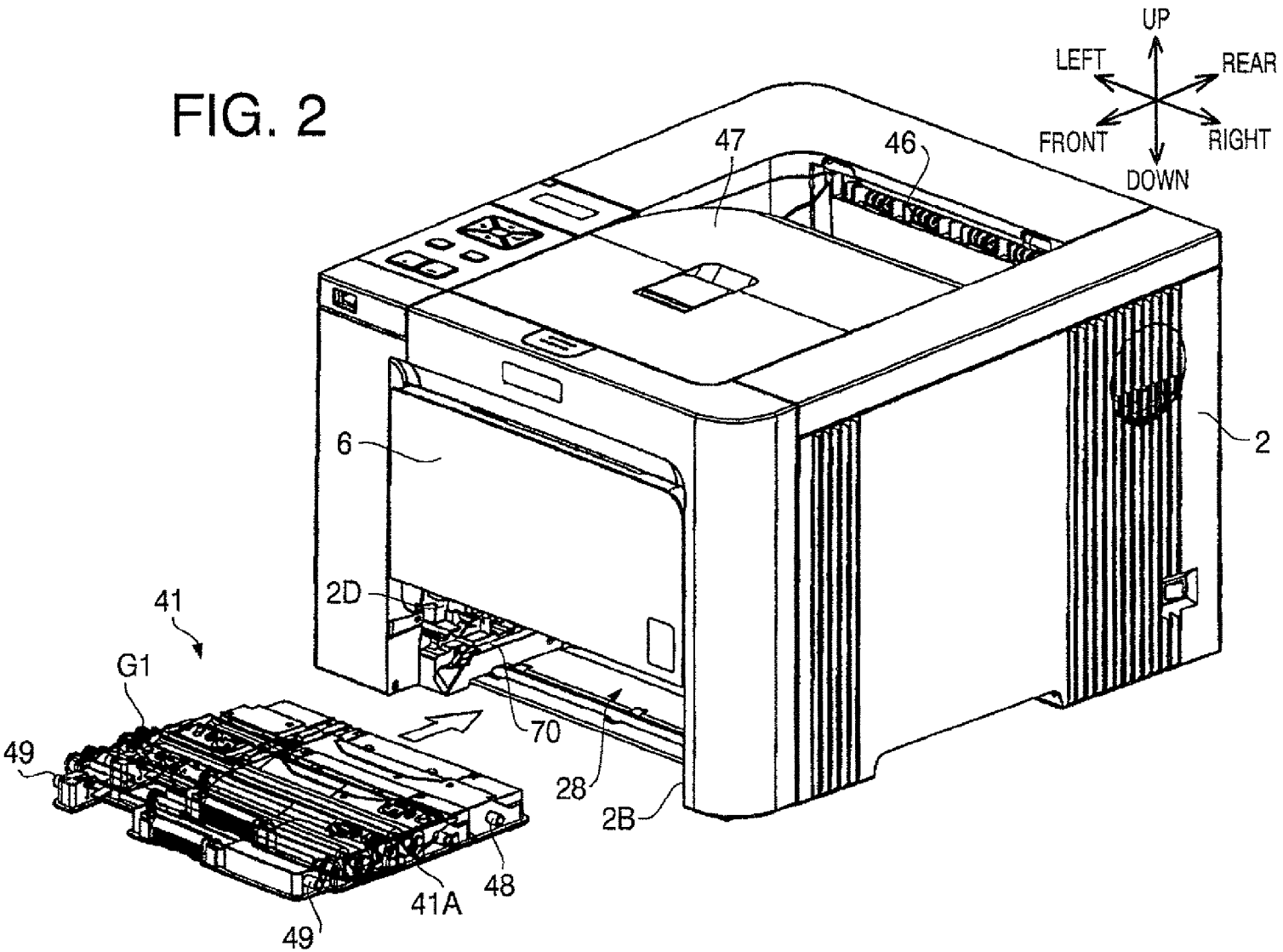
FIG. 2 is a perspective view of a casing and a cleaning unit of the printer shown in FIG. 1.

FIG. 1 is a cross-sectional side view of the printer 1. FIG. 2 is a perspective view of a casing 2 of the printer 1 and a belt cleaning unit 41 which is detachable/attachable with respect to the casing 2. As indicated in FIG. 1, a right-hand side of the drawing is referred to a front side of the printer 1, and a left-hand side of the drawing is referred to as a rear side of the printer 1.

The printer 1 is a color laser beam printer of a what is called direct tandem type and provided with four photoconductive drums 30 corresponding to black, cyan, magenta and yellow components of an image. The printer 1 has the casing 2, which is provided with a sheet supplying unit 4 for feeding printing sheets 3, a scanning unit 18 for exposing the photoconductive drums 30 with laser beams, an image forming unit 20 for forming an image on the printing sheets fed by the sheet supplying unit 4, a sheet feeding unit 35 for feeding the printing sheets 3 inside the printer 1 and the belt cleaning unit 41.

An opening 2A is formed on an upper front surface of the casing 2, and an opening 2B is formed on a lower front surface of the casing 2. The opening 2A is exposed to outside when a front cover 6 of the casing 2 is opened. The printer 1 is configured such that the image forming unit 20, the sheet feeding unit 35 can be detached from the printer 1 and removed through the opening 2A. As shown in FIG. 2, at a rear side of the opening 2B, a cassette accommodation section 28 (described later) is defined for accommodating a sheet supply cassette 7. According to the embodiment, after the sheet supply cassette 7 is removed from the printer 1, the belt cleaning unit 41 can be removed through the opening 2B.

Sheet Supplying Unit

The sheet supplying unit 4 has a sheet supply cassette 7 which is detachably attached to a bottom portion of the casing 2, a separation roller 8 and a separation pad 9 provided above a front end portion of the sheet supply cassette 7, a pickup roller 10 provided on a rear side of the separation roller 8, a pair of scraping rollers 11 and 11 arranged above and on the front side of the separation roller 8, and a pair of registration rollers 12A and 12B.

The sheet supply cassette 7 has a shallow box-like shape with its upper surface is removed. In the sheet supply cassette 7, the printing sheets 3, on which images are formed, are stacked inside the sheet supply cassette 7. The sheet supply cassette 7 is provided with a front wall 13 at its front end side. The front wall 13 is located below a front cover 6 at the front side of the casing 2 when attached to the printer 1. By pulling the front wall 13, the sheet supply cassette 7 is drawn to the front side of the casing 2 horizontally.

On an inner bottom surface of the sheet supply cassette 7, a pressure plate 7A is provided such that a rear side end thereof is rotatably supported, while a front side end thereof is urged upward by a spring (not shown). On the pressure plate 7A, the printing sheets are stacked, front side end portion of which is biased upward.

The uppermost sheet of the printing sheets stacked on the pressure plate 7A is pressed against the pickup roller 10 by the urging force of the pressure plate 7A. As the pickup roller 10 rotates in this state, the uppermost sheet is fed toward a nip between the separation roller 8 and the separation pad 9. As the separation roller 8 is rotated, even if a plurality of sheets are fed from the stack of sheets 3, only one sheet is separated and passed through the nip between the separation roller 8 and the separation pad 9, and fed further. The separated one sheet passed through the nip between the separation roller 8 and the separation pad 9 is fed to the scraping rollers 11 and 11, which removes dust/particles attached on the sheet. Then, the sheet is further fed toward the registration rollers 12A and 12B.

The registration rollers 12A and 12B are a driving roller (12A) and a driven roller (12B), which feeds the printing sheet 3, after registering, toward the transfer belt 38 via a feeding path 14. The feeding path 14 has a U-shaped path with its curved portion located on the front side such that the printing sheet 3 proceeding from the rear side to the front side is turned at the curved portion and proceeds from the front side toward the rear side (i.e., toward the transfer belt 18) of the sheet feeding unit 35, which will be described later.

Scanning Unit

The scanning unit 18 is arranged at an uppermost portion inside the casing 2. The scanning unit 18 emits four scanning and modulated laser beams on the photoconductive surface of the photoconductive drums 30 for forming four color component images (i.e., black, magenta, cyan and yellow image components), respectively, based on image data. According to the embodiment, the four laser beams are emitted from the bottom surface of the scanning unit 18 toward lower rear directions, respectively.

Image Forming Unit

Inside the casing 2, the unit accommodation section 29 is defined, which communicates with the opening 2A below the scanning unit 18. In the accommodation section 29, the image forming unit 20 is detachably/attachably accommodated. The image forming unit 20 can be pulled out in the front direction. The image forming unit 20 has a frame 21, which holds the four photoconductive drum 30, four scorotron type chargers 31, four developing cartridges (toner cartridges) and four cleaning brushes 33. It should be noted that the four sets of components have the same configuration. Therefore, reference numerals are assigned only to the leftmost set components.

The four developing cartridges 22 contains black, cyan, magenta and yellow toners, respectively, and are detachably attached to the frame 21. Each developing cartridge 22 has a box-like accommodating casing 23 with its bottom being formed an opening. At an upper portion inside the casing 23, a toner chamber 24 for accommodating toner T of each color is defined. In the toner chamber 24, an agitator 24A for agitating the toner T is provided. Below the toner chamber 24, a toner supplying roller 25, a developing roller 26 and a thickness regulating blade 27 are arranged.

When developing process is executed, the toner T discharged from the toner chamber 24 is supplied to the developing roller 25 by rotation of the supplying roller 25. At this stage, the toner T is positively charged by frictional electrification between the supplying roller 25 and the developing roller 26. The toner T supplied onto the developing roller 26 enters a clearance between the thickness regulating blade 27 and the developing roller 26 as the developing roller 26 rotates, and charged further by the frictional electrification. As a result, the positively charged toner T is carried by the circumferential surface of the developing roller 26 as a layer having a predetermined thickness.

The circumferential surface of the photoconductive drum 30 is evenly and positively charged by the charging unit 31. As the modulated laser beam L scans on the circumferential surface of the photoconductive drum 30, which is rotated, a two dimensional electrostatic latent image corresponding to the image to be formed on the printing sheet 3 is formed. Then, as the developing roller 26 rotes, when the toner T carried by the developing roller 26 faces the photoconductive drum 30, the toner T is adhered on the electrostatic latent image formed on the photoconductive drum 30. Thus, the electrostatic latent image on the photoconductive drum 30 is developed (i.e., a visible toner image is formed on the photoconductive drum 30). Specifically, on the surfaces of the four photoconductive drums, the toner images of four different colors are formed, respectively.

Thereafter, when the printing sheet 3 fed by the transfer belt 38 passes through a transfer position, which is a position between each pair of the photoconductive drum 30 and the transfer roller 39, the toner image is transferred to the printing sheet 3 by a negative transfer bias applied to the transferring roller 39. The printing sheet 3 on which the toner images are transferred is fed toward the fixing unit 42.

Sheet Feeding Unit

The sheet feeding unit 35 is arranged below the image forming unit 20 accommodated in the unit accommodating section 29. The sheet feeding unit 35 is provided with a pair of supporting rollers 36 and 37, which are spaced by a predetermined distance and parallel to each other, and the transfer belt 38 which is an endless belt wound around the pair of supporting rollers 36 and 37. When the rear side supporting roller 36 is driven to rotate by a motor (not shown), the transfer belt 38 circularly moves.

In a space (section) surrounded by the transfer belt 38, the four transfer rollers 39 respectively face the four photoconductive drums 30 are arrange along a front-rear direction with at constant intervals. Thus, each transfer roller 39 faces a corresponding photoconductive drum 30 with the transfer belt 38 located therebetween. Below the transfer belt 38, the belt cleaning unit 41 is provided. The belt cleaning unit 41 is provided with a cleaning roller 40 for removing residual toner T adhering on the transfer belt 38, particles of paper and the like. In the following description, the residual toner T is referred to as representative of dust/particles and the like adhering on the transfer belt 38, which should be removed by the belt cleaning unit 41.

The printing sheet 3 fed by the registration rollers 12A and 12B passes through the sheet feed path 14 and contacts the upper front end portion of the transfer belt 38. Then, the printing sheet 3 is electrostatically attracted by the upper surface of the transfer belt 38, and fed to the rear side in accordance with the circular movement of the transfer belt 38.

Fixing Unit

The fixing unit 42 is arranged, inside the casing 2, on the rear side of the sheet feeding unit 35. The fixing unit 42 includes a heat roller 43 and a pressure roller 44, which are arranged to face each other to fix the toner image transferred on the printing sheet 3 by applying heat and pressure as the printing sheet 3 passes through the nip therebetween. Then, the printing sheet 3 on which the toner image has been fixed is fed toward discharging rollers 46 arranged at an upper portion of the casing 2 by the feeding rollers 45 which are arranged at an obliquely upper-rear position with respect to the fixing unit 42. On the upper surface of the casing 2, a discharged sheet tray 47 having a substantially horizontal front portion and a downwardly inclined rear portion is formed. The printing sheets 3 bearing the formed images and discharged by the discharge rollers 46 are stacked on the discharged sheet tray 47.

Belt Cleaning Unit

Figure 3:
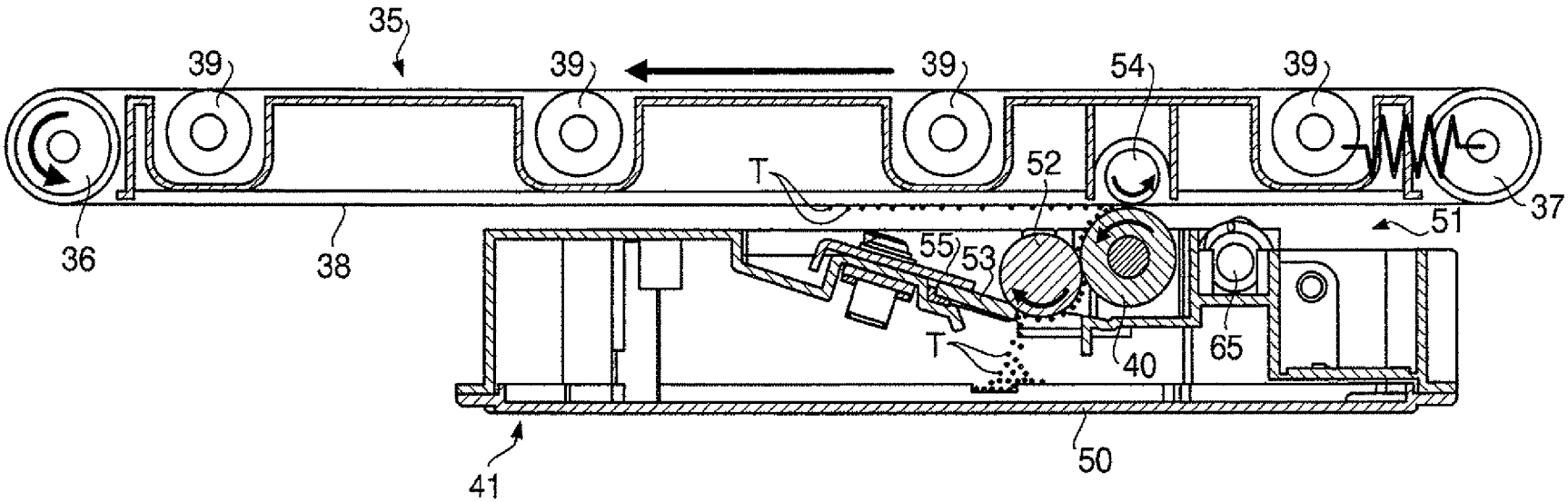
FIG. 3 is an enlarged cross-sectional side view of a sheet feed unit and the belt cleaning unit of the printer shown in FIG. 1.

FIG. 3 is a enlarged side view showing a part of the sheet feeding unit 35 and the belt cleaning unit 41 according to the embodiment.

The belt cleaning unit 41 has a box-like case 50, which is arranged below the transfer belt 38. The case 50 is formed with an opening 51 on an upper front end portion. At the opening 51, inside the case 50, the cleaning roller 40 is rotatably provided. The cleaning roller 40 is a silicon-foamed roller configured such that a metal roller core is covered (coated) with a roller body made of conductive foamed member (i.e., foamed silicon).

At an obliquely lower rear position with respect to the cleaning roller 40, another roller 52 made of hard material such as metal is provided. According to the embodiment, the roller 52 is a metal roller. The metal roller 52 is rotatable and is urged toward the cleaning roller 40. Below the metal roller 52, a scraping blade 53 made of rubber is provided. The rear end portion of the scraping blade 53 is sandwiched and fixed in position by a metal holder 55. The front end portion (i.e., the distal end portion) of the scraping blade 53 is press-contacted against the meal roller 52 from the lower side thereof Above the cleaning roller 40, a backup roller 54 made of conductive material such as conductive metal is rotatably provided such that the transfer belt 38 is nipped between the backup roller 54 and the cleaning roller 40.

As shown in FIG. 2, during the cleaning process which is executed after the printing sheet 3 on which an image is formed passes through the fixing unit 42 and until the printing sheet 3 is discharged by the discharge rollers 46, the cleaning roller 40 is driven by a not-shown motor in counterclockwise direction in FIG. 3. Thus, the cleaning roller 40 rotates in a direction opposite to the moving direction of the transfer belt 38 at a position where the cleaning roller 40 contacts the transfer belt 38. As the cleaning roller 40 rotates counterclockwise, the metal roller 52, which contacts the cleaning roller 40, rotates in the clockwise direction. The backup roller 54 is driven, by the transfer belt, to rotate in the counterclockwise direction as the transfer belt 38 moves.

On one side surface (on the left side surface, according to the embodiment) of the belt cleaning unit 41, an input gear G1 is provided as exposed to outside, as shown in FIG. 2. The input gear G1 is to engage with a driving gear G2 provided inside the casing 2. The driving force of the driving gear G2 is transmitted to the input G1, thereby the cleaning roller 40 and the backup roller 54 are driven to rotate, respectively.

The shaft of the backup roller 54 is grounded. When the cleaning operation is executed, a negative bias voltage is applied to the cleaning roller 40 and a stronger negative bias voltage is applied to the metal roller 52. With this configuration, the residual toner T, the dust/particles of the printing sheet 3 and the like adhering to the transfer belt 38 is moved to the cleaning roller 40 at a position where the cleaning roller 40 and the backup roller 54 are oppositely arranged, by the bias-attracting force and contact force of the cleaning roller 40. Then, the residual toner T and the like carried by the cleaning roller 40 moves to the rigid metal roller by the bias-attracting force. The residual toner T and the like carried by the metal roller 52 is then scraped by the scraping blade 53 and collected inside the case (i.e., collecting box) 50.

Structure of Accommodating Belt Cleaning Unit

Next, a structure for accommodating the belt cleaning unit 41 inside the casing 2 will be described.

Inside the casing 2, a unit accommodation section 29 is defined above the cassette accommodation section 28. The unit accommodation section 29 is configured such that an opening is formed on an inner upper surface so that the cleaning roller 40 is exposed, while substantially an entire area of the bottom surface is opened to communicate with the cassette accommodation section 28.

Figure 4:
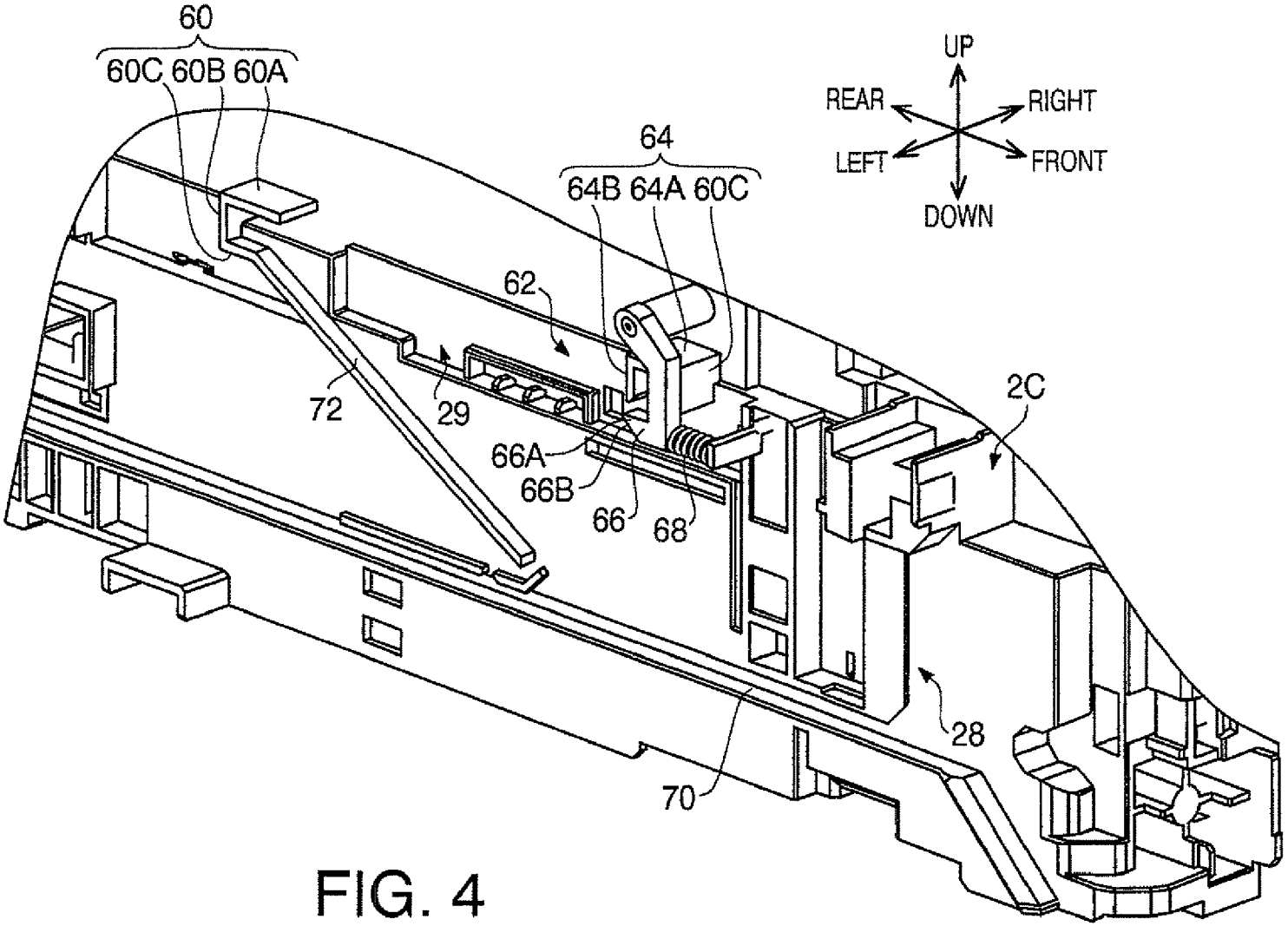
FIG. 4 is a perspective partial view showing an inner structure of a right side wall of the casing of the printer according to the embodiment.
Figure 5:
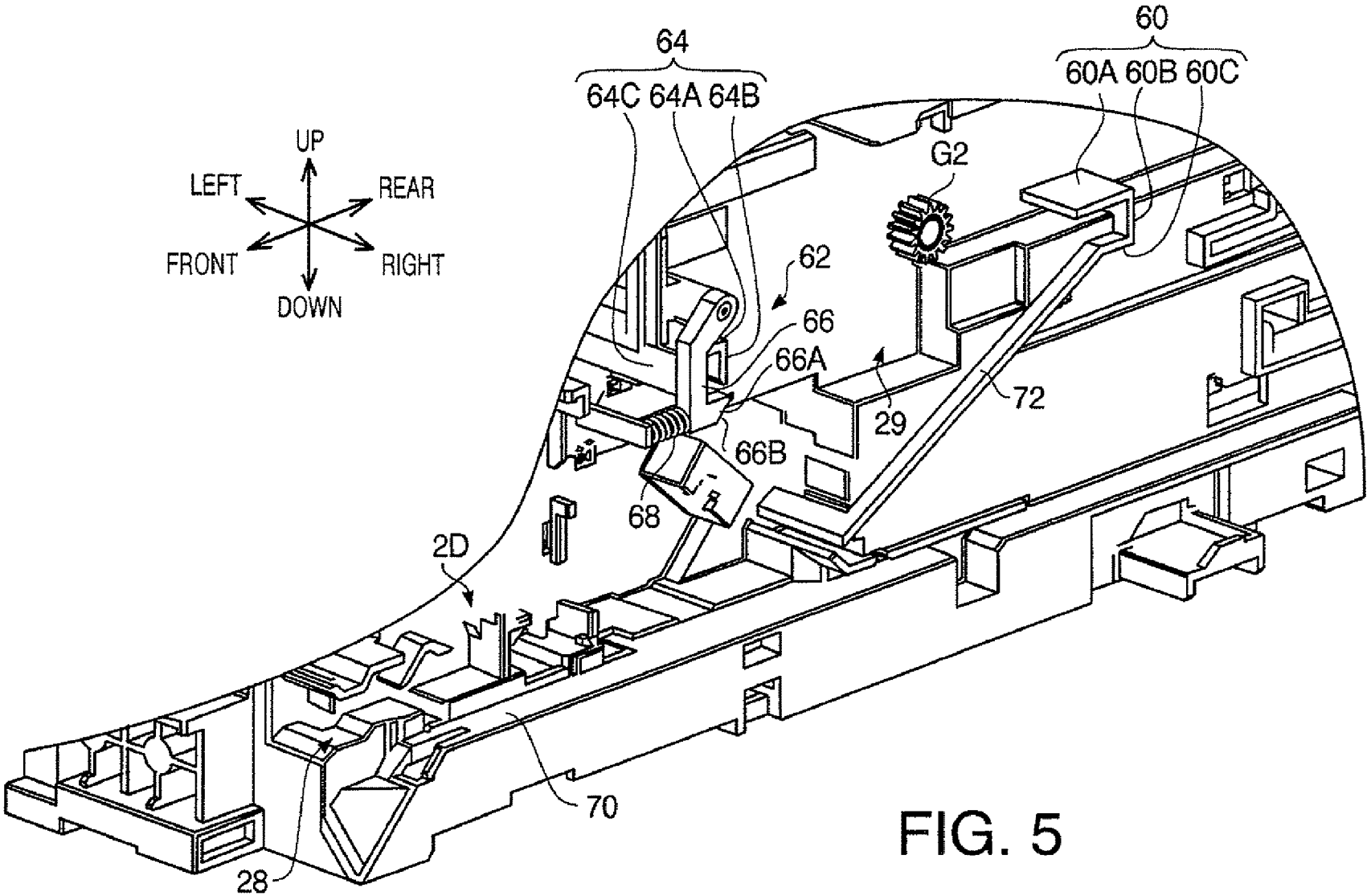
FIG. 5 is a perspective partial view showing an inner structure of a left side wall of the casing of the printer according to the embodiment.

FIG. 4 is a perspective view of a part of the inner right wall 2C of the casing 2, and FIG. 5 is a perspective view of a part of the inner left wall 2D of the casing 2. It should be noted that in FIGS. 4 and 5, indication of "front" corresponds to the front of the printer 1. The cassette accommodation section 28 and the unit accommodation section 29 are defined between the inner right wall 2C and the inner left wall 2D.

Latch Mechanism

In the unit accommodation section 29, a latch mechanism for latching the belt cleaning unit 41 inside the unit accommodation section 29 is provided. As shown in FIG. 2, the belt cleaning unit 41 is formed with first cylindrical projections 48 and 48 (only one of them is shown in FIG. 2) on both side surfaces, at the rear end portion thereof, and second cylindrical projections 49 and 49 on both side surfaces, at the front end portion thereof.

In the unit accommodation section 29, a holding structure 60 is formed on each of the inner walls 2C and 2D. The holding structures 60 receive the first projections 48 formed on the side surfaces of the belt cleaning unit 41. Specifically, each holding structure 60 has a U-shaped structure having an upper wall 60A, rear wall 60B and bottom wall 60C, with its front side end being opened to receive the first projection 48.

At the front end portion of the unit accommodation section 29, latch mechanisms 62 and 62 are provided to the inner side walls 2C and 2D. Each of the latch mechanisms 62 and 62 includes a receptor 64 and a latching arm 66. The receptor 64 is for receiving the second projection 49 of the belt cleaning unit 41. As shown in FIGS. 4 and 5, the receptor 64 has a U-shaped having an upper wall 64A, a rear wall 64B and a front wall 64C, with its bottom side end being opened.

The latching arm 66 is for latching the second projection 49 inserted in the receptor 64. The latching arm 66 is movable to be located at a latching position (see FIGS. 4 and 5) and a releasing position for allowing the second projection 49 to be removed from the receptor 64. Specifically, the latching arm 66 is configured such that the upper end portion thereof is supported rotatably about an axis extending in a right-and-left direction, thereby the lower end portion thereof is rockable in the front-and-rear direction. A latching pawl 66A is formed at the lower end portion of the latching arm 66. When the latching arm 66 is located at the latching position, the latching pawl 66A latches the lower surface of the second projection 49 that is inserted in the receptor 64. The latching arm 66 is biased by a well-known biasing member such as a spring so that the latching arm 66 is neutrally located at the latching position.

Guiding Mechanism

Next, a guiding mechanism for guiding the sheet supply cassette 7 and belt cleaning unit 41 will be described. As shown in FIGS. 2, 4 and 5, on each of the side walls 2C and 2D, a stepped portion 70 extending in the front-to-rear direction is formed over an entire length of the cassette accommodation section 28. The stepped portions 70 and 70 constitute a guiding mechanism which is principally formed to contact the bottom surface of the sheet supply cassette 7 and guide the sheet supply cassette 7 to the cassette accommodation section 28.

The stepped portions 70 and 70 also contact the side end portions 41A and 41A of the belt cleaning unit 41 and guide the belt cleaning unit 41 to a halfway position in the cassette accommodation section 28. The printer 1 is further provided with another guiding mechanism which guides the belt cleaning unit 41 having been guided by the stepped portions 70 and 70 to the unit accommodation section 29. Specifically, on the inner surface of each of the side walls 2C and 2D, a guide rail 72 is provided as shown in FIGS. 4 and 5. When the belt cleaning unit 41 is guided halfway by the stepped portions 70 and 70, the first projections 48 and 48 of the belt cleaning unit 41 contact the guide rails 72 and 72, respectively. If the belt cleaning unit 41 is farther inserted, the first projections 48 and 48 are guided rear-upward direction by the guide rails 72 and 72 to the holding structures 60 and 60.

FIGS. 6, 7 and 8 schematically show a process of inserting the belt cleaning unit 41 into the unit accommodation section 29.

After detaching the sheet supply cassette 7 from the casing 2, the side end portions 41A and 41A of the belt cleaning unit 41 on the stepped portions 70 and 70 and the belt cleaning unit 41 is pushed to further inserting the belt cleaning unit 41. As pushed, the first projections 48 and 48 contact the guided by the guide rails 72 and 72, respectively. Then, the first projections 48 and 48 are guided to the holding structures 60 and 60.

At this stage, it becomes possible to lift the front end of the belt cleaning unit 41 by rotating the belt cleaning unit 41 about the first projections 48, which are held by the holding structures 60 and 60 as shown in FIG. 7. By pushing up the front end of the belt cleaning unit 41, the second projections 49 and 49 moves the latching arms 66 and 66 to the releasing positions against the urging force of the springs 68 and 68, and are inserted in the receptors 64 and 64, respectively. The latching arms 66 and 66 return their neutral positions (i.e., the latching positions as shown in FIGS. 4 and 5) by the biasing force of the springs 68 and 68. Thus, the first projections 48 and 48 are held by the holding structures 60 and 60, respectively, and the second projections 49 and 49 are latched by the receptors 64 and 64, and the latching arms 66 and 66, respectively. With this configuration, the belt cleaning unit 41 is located at a predetermined position since the position thereof is adjusted in the up/down and right/left directions. After attaching the belt cleaning unit 41 in the unit accommodation section 29, the sheet supply cassette 7 can be inserted in the cassette accommodation section 28.

According to the above-described embodiment, each of the second projections 49 and 49 has a cylindrical shape. Further, each latching arm 66 is formed that the tip portion thereof is formed to have a tapered surface 66B for introducing the second projection 49 to the receptor 64. Further, the open end of the receptor 64 is formed such that the outer portion is wider than the inner portion. Therefore, even if the latching arm 66 is not fully moved to the releasing position, simply by lifting the front end of the belt cleaning unit 41, the second projection 49 pushes the tapered surface 661B so that the latching arm 66 is moved toward the releasing position, and the second projection 49 can be inserted in the receptor 64 easily.

The driving gear G2 is located on the rear side of the input gear G1 viewed along a direction in which the belt cleaning unit 41 is inserted in the unit accommodation section 29. Specifically, the input gear G1 and the driving gear G2 are aligned on substantially the same circle having its center on the first projection 48 (see FIG. 7). Therefore, when the belt cleaning unit 41 is attached/detached, the gears G1 and 62 do not interfere with each other. That is, the driving gear G2 does not obstacle the attaching/detaching movement of the belt cleaning unit 41.

When the residual toner T collected in the case 50 is disposed, a user firstly detaches the sheet supply cassette 7 from the cassette accommodation section 28 to make the cassette accommodation section 28 vacant. Thereafter, the user moves the latching arms 66 and 66 to their releasing positions manually. It should be noted that operation levers interlocked with the latching arms 66 and 66 may be optionally provided to move the latching arms 66 and 66 to the releasing positions.

When the latching arms 66 and 66 are moved to the releasing positions, latching of the latching mechanism 62 is released, and the front end portion of the belt cleaning unit 41 moves downward. At this stage, the belt cleaning unit 41 is inclined as shown in FIG. 7. Then, the user grasps the front end portion of the belt cleaning unit 41 and pulls out the same through the cassette accommodation section 28.

As described above, according to the embodiment, by detaching the sheet supply cassette 7, the user can detach the belt cleaning unit 41 through the cassette accommodation section 28, without detaching the sheet feeding unit 35 or the image forming unit 20.

Further, according to the embodiment, as the guiding mechanism for guiding the belt cleaning unit 41 to the unit accommodation section 29 when it is inserted through the cassette accommodation section 28 is provided, the user can easily attach the belt cleaning unit 41 at the unit accommodation section 29 even if the cassette accommodation section 28 is relatively narrow.

The stepped portions 70 and 70 for guiding the sheet supply cassette 7 are commonly used for guiding the belt cleaning unit 41 halfway, and the guiding rails 72 dedicated for guiding the belt cleaning unit 41 to the unit accommodation section 29 are provided thereafter. Therefore, the dedicated guiding mechanism can be made compact.

In the above-described embodiment, the guide rails 72 are fixed to the inner side walls 2C and 2D, respectively. It may be possible to modify the guide rails 72 such that they are movable between a guiding position as in the above-described embodiment, and a retracted position in which the guide rails are retracted from an insertion path of the belt cleaning unit 41. That is, the guide rails may be located at the positions as shown in FIGS. 4-7 when the belt cleaning unit 41 is to be inserted in/removed from the unit accommodation section 29, while the guide rails may be lifted up to locate at the bottom of the unit accommodation section 29.

According to the embodiment, the guide rails 72 and 72 are fixed to the side walls 2C and 2D, and arranged so as not to interfere the insertion of the sheet supply cassette 7. Therefore, a mechanism for moving the guiding rails are not necessary.

According to the above-described embodiment, the latching mechanism 62 is provided on the front side of the casing 2, from which the belt cleaning unit 41 is inserted/removed. Therefore, in comparison with a case where the latching mechanism is provided on the rear side, attaching/detaching operations can be used conveniently.

The present invention need not be limited to the above-described configuration according to the embodiment. The configuration may be modified as indicated below without departing from the gist of the invention.

In the embodiment described above, the case 50 of the belt cleaning unit 41 serves as the collection box which collects the removed dust/particles such as the residual toner T. This configuration can be modified such that an collection box which is detachably attached to the printer 1 and does not have the belt cleaning device may be employed.

In the description, the laser beam printer 1 is described as an embodiment of the image forming apparatus. The invention need not be limited to this configuration, and can be applied to various types of the image forming apparatus, which may include a facsimile machine, a multi-function peripheral having functions of printer and scanner, or the like. Further, the printer need not be limited to the tandem type, in which a plurality of developing units apply respective color toners to a plurality of photoconductive drums, respectively, but a four-cycle type, in which the plurality of developing units apply the color toners onto a single photoconductive drum sequentially. The present invention may be applied to each of the image forming devices of a direct transfer system which transfer the developed image directly on the printing sheets, and of an intermediate transfer system which indirectly transfer the developed image, using an intermediate transfer belt, onto the printing sheets. Further, the printer may be an LED (Light Emitting Device) printer instead of the laser beam printer.

As the belt cleaning unit, one employing a cleaning brush or cleaning blade, instead of the cleaning roller as in the embodiment, may be used.

What is claimed is:

1. An image forming apparatus, comprising:

a cassette configured to accommodate printing sheets;

a casing of the image forming apparatus;

a belt member which circularly moves inside the casing;

a cleaning device configured to remove particles adhering on the belt member; and a collection box in which the particles removed by the cleaning device are collected, wherein the casing has:

a cassette accommodating section for accommodating the cassette;

a box accommodating section defined inside the casing and communicating with the cassette accommodating section; and an opening formed on the casing and communicating with the cassette accommodating section, wherein the cassette is removably installable into the cassette accommodating section through the opening, and wherein the collection box is detached from or inserted in the box accommodating section through the opening.

2. The image forming apparatus according to claim 1, further comprising a guiding mechanism configured to guide the collection box inserted through the opening to the box accommodating section.

3. The image forming apparatus according to claim 2, wherein the guiding mechanism includes a pair of inclined structures respectively provided to inner side surfaces defining the cassette accommodating section, the inclined structures contacting the collection box and directing the collection box from the cassette accommodating section to the box accommodating section as the collection box is inserted deeper in the cassette accommodating section.

4. The image forming apparatus according to claim 1, wherein the box accommodating section is provided with:

a contact portion at a deeper end of the box accommodating section, the contact portion contacting an insertion side end portion of the collection box; and a latching mechanism provided at an opening side end portion of the box accommodating section, the latching mechanism being configured to releasably latch an opening side end portion of the collection box when accommodated in the box accommodating section.

5. The image forming apparatus according to claim 1, wherein the cleaning device is provided to the collection box, the collection box being provided with an input gear which transmits a driving force to the cleaning device, and wherein the image forming apparatus has a driving gear which is located on a rear side of the input gear of the collection box viewed from the opening side, the driving gear engaging with the input gear and input a driving force to the input gear.

* * * * *